United States Patent [19]

Soukup et al.

[11] 3,971,192

[45] July 27, 1976

[54] DEVICE FOR THE DISPLACEMENT OF FILLING MATERIAL AND THE SHAPING OF A MATERIAL WEB IN A PACKING MACHINE

[75] Inventors: Franz Soukup, Malmo; Bengt A. Rosberg, Hoor; Tore I. Larsson, Loddekopinge; John-Erik Brunlid, Lund, all of Sweden

[73] Assignee: Tetra Pak Development, Switzerland

[22] Filed: May 27, 1975

[21] Appl. No.: 580,724

[30] Foreign Application Priority Data

June 28, 1974 Sweden ..... 7408564

[52] U.S. Cl. ..... 53/184 R; 53/124 A; 53/373

[51] Int. Cl.[2] ..... B65B 1/24

[58] Field of Search ..... 53/184, 113, 124 CC, 53/124 R, 124 A, 124 C, 373

[56] References Cited

UNITED STATES PATENTS

| | | | |
|---|---|---|---|
| 3,020,687 | 2/1962 | Joa | 53/124 CC X |
| 3,481,283 | 12/1969 | Vogt | 53/184 UX |
| 3,759,011 | 9/1973 | Akke | 53/184 |

*Primary Examiner*—Travis S. McGehee
*Assistant Examiner*—Horace M. Culver

[57] ABSTRACT

The packing machine of the invention molds a first material web into a line of connected U-shaped sections; joins a second material web to the first material web and seals them together; fills the resulting cavities with an intended filling material; seals the filled cavities, and finally separates the line into individual filled packages.

6 Claims, 2 Drawing Figures

Figure 1:
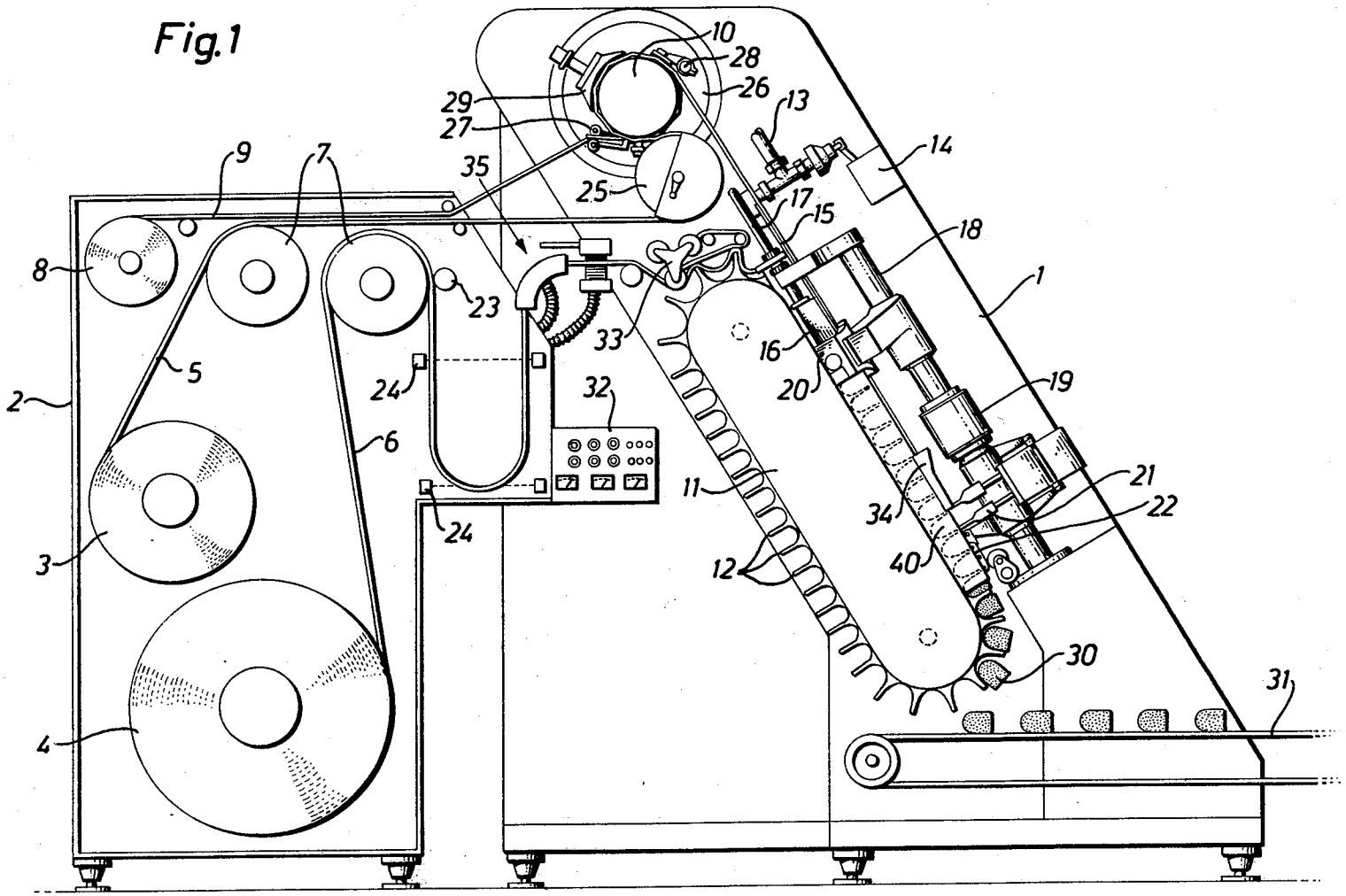

12
6
40
15
5
36
41
37
37
34
38
42
21
39

DEVICE FOR THE DISPLACEMENT OF FILLING MATERIAL AND THE SHAPING OF A MATERIAL WEB IN A PACKING MACHINE

The present invention relates to a packing machine, which comprises an arrangement for the formation of a first continuous web of a foldable material into a line of connected U-shaped sections by pressing the web down into a movable chain of connected moulds, an arrangement for joining a second web of foldable material to the first web, an arrangement for folding down the edge zones of the second web until they are in contact with the edges of the folded first web, an arrangement for sealing the combined portions of the first and the second web along the contacting surfaces of the webs to form a line of communicating packages or cavities, an arrangement for filling the said cavities with the intended filling material, an arrangement for the final sealing of the individual cavities, and an arrangement for the separation of the individual packages.

The final sealing of the individual cavities, that is to say the interruption of the communication between the cavities which is necessary for filling, takes place in a known type of machine in such a manner that the central part of the second material web is brought into contact with, and is sealed to, the parts of the first material web which form the interconnecting flanges of successive U-shaped sections. This is achieved by means of a sealing jaw which presses the two material webs against the underlying mould chain and welds together the webs by means of ultrasonics.

As the mould chain is advanced at continuous speed the sealing jaw is arranged so, that when in one working stroke it presses together and welds the material web, it moves at the same time parallel with and at the same speed as the mould chain, whilst when in a position removed from the material webs, it is rapidly moved in the opposite direction to the movement of the mould track, so as again to press together the material webs and carry out the next successive step.

A pre-condition to make possible the welding together of the material webs without interference is that the sealing jaw when pressing together the two material webs also displaces the filling material completely from the surfaces of the webs to be joined, so that the material surfaces are in contact with one another. This is particularly difficult with fatty filling materials, e.g. cream and the like, and it has not been possible until now to solve the problem in a satisfactory manner.

In the abovementioned type of machine, the filling of the connected cavities which afterwards are to form the individual packages, takes place by means of a filler tube which extends in between the two material webs at the starting end and is situated with the mouth of the tube between the place where the cavity is formed and the place at which the final sealing of the cavity takes place. The interconnected and not yet finally sealed cavities thus form a "channel", which extends at an angle of approx. 45° to the horizontal plane and into which the filling material is introduced by means of the filler tube. Owing to the continuous supply of filling material, the lower end of the cavity channel will be entirely filled with the filling material. Since the central zone of the second material web has to be bulged outwardly so as to accommodate the filler tube, the finished filled package will also have a somewhat convex surface. This disadvantage has been partly reduced by giving filler tube a suitable shape (that is to say flattened out), but this does not completely eliminate the problem.

The abovementioned problem has thus not been solved satisfactorily until now.

It is an object of the present invention to provide an arrangement which completely eliminates the abovementioned problem and, in a safe manner, displaces excess filling material from the surfaces of the webs to be joined flattens the central zone of the second material web.

This has been achieved in accordance with the invention by a device of the type described hereinafter which comprises a mat-shaped part which is situated directly before the final sealing arrangement and is reciprocatingly movable along an angular track, whose rear portion, seen in the direction of movement of the mould chain, is situated directly adjoining and parallel to the second material web, whilst the front portion is arranged at an angle to the material web.

The preferred embodiments of the device in accordance with the invention have the characteristics which are evident from the following description.

Owing to the device having been given the shape in accordance with the invention the displacement of the excess filling material and the shaping of the central zone of the material web will take place substantially when the continuous line of packages, after filling, passes the stationary wedge-shaped part, whereupon the second material web is pressed by the mat element against the first material web, so that the filling material cannot again flow between the surfaces which are to be welded together. Since the mat element is connected to the final sealing arrangement and is movable together with the same, it will, in spite of variations in the distance between the final sealing arrangement and a wedge-shaped element, completely cover the space between them.

The invention will be described in detail in the following with reference to the enclosed schematic drawings.

Figure 2:
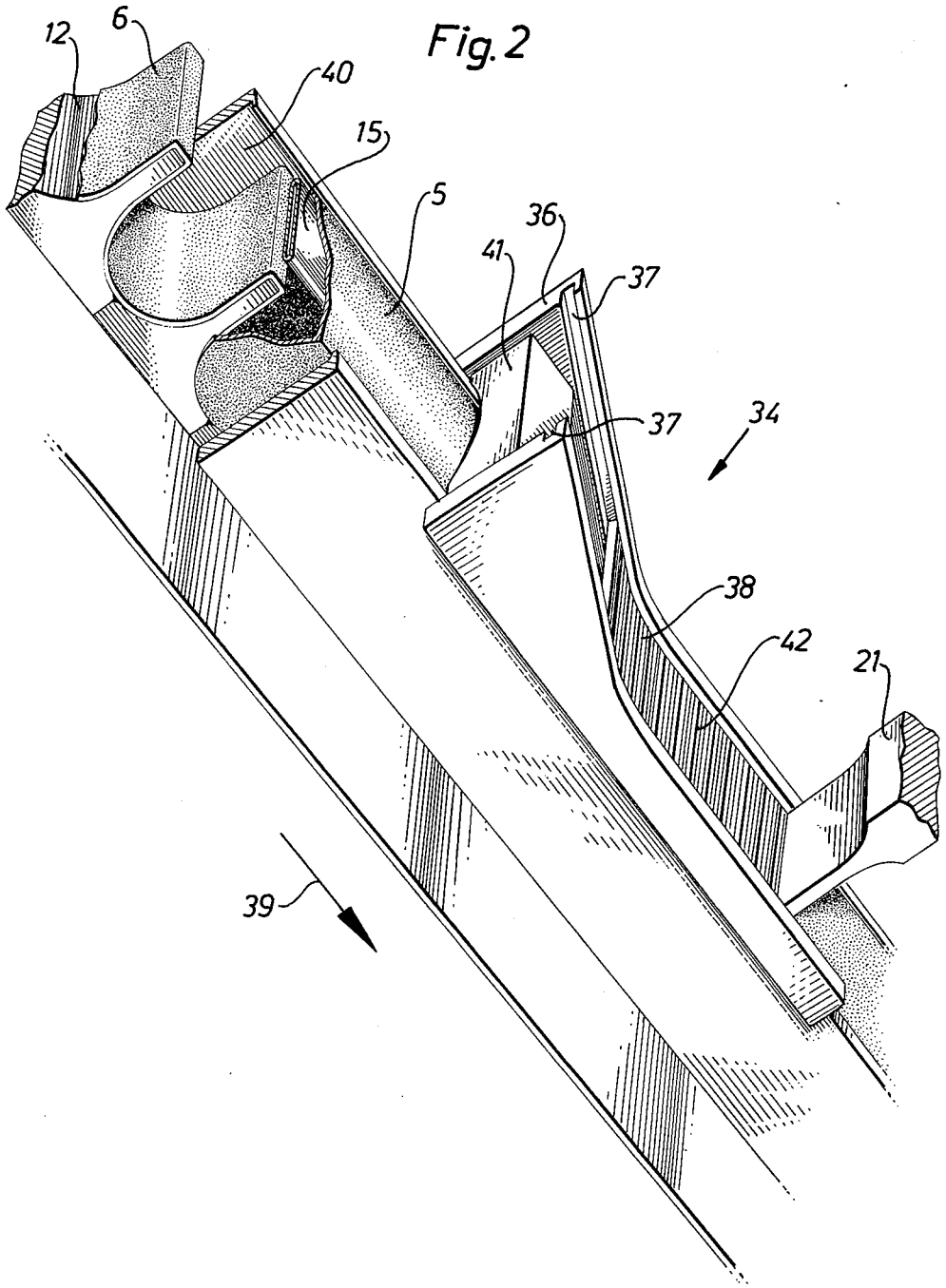

FIG. 1 shows a packing machine with a device in accordance with the invention, and FIG. 2 shows the device in accordance with the invention in perspective view.

In FIG. 1 is shown a front elevation of a packing machine with a shaping and displacement device in accordance with the invention, the frame of the packing machine proper being given the reference numeral 1 and a housing for packing housing materials the reference numeral 2.

The housing 2 comprises a number of so-called roller stands comprising magazine rolls of packing material. The rollers 3 and 4 carry packing material webs, which e.g. are constituted of extruded foamed plastic webs of polystyrene material, which are coated on both sides with layers of homogeneous polystyrene. The packing material webs 5 and 6 are rolled off the magazine rollers 3 and 4 and are passed over the guide rollers 7. The magazine roller 8 carries strip material 9 of homogeneous plastic material, which strip material 9 is intended to be used as a removable cover material over an opening provided in the finished package.

The packing machine proper consists, as mentioned above, of a frame 1, which carries a rotating drum 10 over which is guided the packing material web 5 and on which working operations are carried out at stations along the periphery of the drum. The packing machine comprises further an arrangement 11 for the forming of the web 6. The arrangement 11 comprises movable moulds 12, which are attached to an endless chain, which in the illustration moves in clockwise direction. In FIG. 1 moreover a delivery line for filling material is designated 13, a control valve for the control of the quantity of filling material delivered 14 and a filler tube 15. A heating equipment is designated 16 and an air delivery line 17. A column capable of reciprocating movement is designated 18 and a bearing fixed to the machine frame 1 for the guiding of the column is designated 19. The column 18 carries a folding equipment 20, a sealing element 21 and cutting elements 22, which all move together with the column in the reciprocating movement of the latter, adapted so that the column moves synchronously with the moulds during its downwards movement, whilst the upwards, return movement is faster. The movement of the column also controls the device in accordance with the invention which has been given the reference numeral 34 and will be described in more detail in the following.

The packing material operates in the following manner:

A first packing material web 6 provided with crease lines is rolled off the magazine roller 4 and is passed over a guide roller 7. The packing material web 6 is rolled off with the help of a driving roller 23, which is controlled with the help of a photo-cell device comprising two photo-cell arrangements 24. If too much packing material web 6 is rolled off by means of the driving roller 23, the loop of packing material web formed will cover the bottom of the lower photo-cell device 24, whereby a pulse is transmitted to the governor and the driving arrangement for the driving roller 23 is stopped (FIG. 1). This means that the advance of the packing material is interrupted, so that the loop of packing material is reduced. When the loop has become so small that the top of the lower photo-cell device 24 is cleared, the advance of packing material is started again with the help of the driving roller 23. The packing material web 6 is brought into contact with the moulds 12 on the forming arrangement 11, on which the moulds 12 are attached to an endless chain, which moves at constant speed in a closed track. After being heated by means of a heating unit 35, the packing material web 6 is brought with the help of a forming device 33 into contact with the moulds 12, whilst the web 6 is folded to form an endless line of U-shaped parts, which, with the help of the forming arrangement 11, are made to move substantially downwards at a constant speed.

The second packing material web 5 is rolled off its magazine roller 3 and is passed over a guide roller 25, whereupon it is made to lie against the feed drum 10. This drum, as mentioned earlier, has a number of sections or forming surfaces, each of which has a width which substantially corresponds to the distance between two successive moulds 12 on the forming arrangement 11. The feed drum 10 rotates at constant speed whilst an outer rim or oscillator plate 26 moves in a reciprocating driving movement around the drum 10. The plate 26 carries machining elements, such as the hole-punching and cover strip applicator 27, the forming and cutting element 28 and the heating device 29. When the web 5, with the help of the feed drum 10, is taken past the machining stations 27–29 the punching of the pouring hole on the web, the placing of the cover strip over the pouring hole, the heating and possible thermoforming of the web, and the cutting of the edge zones of the web, substantially at right angles to the longitudinal direction of the web, are carried out. A strip 9 of homogeneous plastic material is rolled off the magazine roller 8, which strip is applied by means of the cover strip applicator 27 over the pouring hole produced in the web 5 and is fixed to the web 5 so that the pouring hole is covered. Furthermore, the front part of the strip 9 is cut off with the help of the cover strip applicator 27 so that the part of cover strip applied over the pouring hole is severed from the strip 9. The edge zones of the web 5 provided with pouring opening and opening device have been modified by cutting, to form a succession of tongues projecting transversely from the longitudinal edge of the web, whose length substantially corresponds to the height of the moulds 12. The web is advanced with the help of the feed drum 10 at a speed which is identical with the speed of movement of the moulds 12, the web 5 being passed forwards and being placed with its central part over the tops of the moulds 12, whilst the web edge zones, modified into tongues or lugs, project beyond the moulds 12. With the help of a governor, not shown on the drawing, the web 5 is advanced in such a manner, that the slots in the web are placed right at the transverse flanges or partition walls of the moulds 12.

Whilst the web 5 is advanced with the help of the feed drum 10 synchronously with the movement of the moulds 12, the column 18 attains an upper end position and starts a downward movement, which is also synchronous with the movement of the moulds 12. The column 18 carries a heating device 16, which can be connected by a tube 17 to an air source, and, with the help of the heating device 16, hot air is blown against the underside of the edge zones or lugs of the web 5 whereby the plastic material is softened and activated for sealing, and at the same time the edges of the web 6 are also heated, in that hot air is blown against the web edge zones exposed at the lateral edges of the moulds.

At the same time as the zones of the webs 5 and 6, which are intended to be sealed to one another, is carried out by means of the heating device 16, the lugs or tongues of the web 5, which were heated during the previous working stroke of the column 18, are folded down by means of folding flaps 20 to lie against the edge zones of the web 6 situated beyond the sides of the moulds 12 which have also been heated earlier, so that the portions of the webs placed on one another are fused together to a mechanically durable and lasting seal, which is stabilized by the cooling down of the sealing area by the folding device 20, during the time the latter is engaged with the folded down portions of the web 5. When the webs 5 and 6 have been joined together by means of lateral seals in the manner described above, the filling material is introduced through the filler tube 15, which is arranged under the web 5 but above the tops of the moulds 12, the compartment-like spaces formed under the web 5 being filled with the intended filling material. Subsequently the webs 5 and 6 pass the element 34 which displaces excess filling material and imparts a plane shape to the central zone of the web 5. The said spaces are then sealed off by means of the sealing device 21 to closed units, in that the web 5 is sealed to the parts of the web 6 which lie over the tops of the upright parts of the moulds 12. The sealing device 21 is also fixed to the column 18 and follows the reciprocating movement of the same, by which the sealing takes place whilst the column moves downwards synchronously with the moulds. The closed units formed are finally severed from one another with the help of the cutting device 22 which separates the units from one another by cutting through the sealing zones which have been produced with the help of the sealing device 21.

The filled and closed packing units 30 are then transferred at the lower end of the mould track to a conveyor 31 for removal and packing into cases or the like.

The packing machine can be operated by means of a control and operating panel 32 comprising the necessary operating elements and also control elements to indicate the temperatures in the different heating zones etc.

In the following will be described in detail the device in accordance with the invention, especially with reference to FIG. 2, which on a larger scale illustrates a part of the packing machine with the device 34 in accordance with the invention.

The figure indicates how during operation the chain consisting of moulds 12 moves in the direction of the arrow 39 between side rails 40. The mould chain has passed earlier, inter alia, the forming device 33, which has formed the first material web to a line of continuous U-shaped sections corresponding to the shape of the moulds 12. Furthermore, the second material web 5, after forming of the tongue-like edge zones, has been joined to the first web 6, whereupon the edge zones have been folded down and have been joined to the edge zones of the firstnamed material web 6 extending beyond the mould chain. Between the central zone of the second material web 5 and the first material web extends the filler tube 15 parallel with the mould chain to end in the vicinity of the front end of the device 34. To allow the placing of the filler tube 15 between the portion of the first material web situated on the flanges of the moulds 12 and the central area of the second material web 5, situated directly above it, the filler tube 15 was given a strongly flattened shape. However, a certain outward bulging of the central area of the second material web 5 is necessary to allow room for the filler tube.

In the vicinity of the mouth of the filler tube 15 is placed the device 34 in accordance with the invention. The device comprises two identical lateral parts 36 (one of which is mirror inverted) which are attached to the respective side rails 40 by means of bolts or the like (not shown). The lateral parts 36 are substantially wedge-shaped and are each provided with a groove 37, which is situated in the sides of the lateral parts facing one another in the vicinity of the upper edge of the lateral parts. The grooves 37 serve to guide a matlike device 38 supported between the lateral parts, which device 38 can perform a reciprocating movement therein. The matlike element 38 is substantially half as long as the groove 37 and at its rear end is joined to the sealing jaw 21. Between the front end of the lateral parts 36 there is a substantially wedge-shaped device 41, whose upper surface extends substantially parallel with the groove 37 and whose lower surface extends substantially parallel with the central area of the second material web 5. The surface of the wedge-shaped device 41 facing towards the material web 5 has at its front end a recess of concave shape, which shape is adapted to the shape the central area of the web 5 has been given on account of the filler tube 15. The recess becomes shallower, seen in the direction of the arrow 39, and in the vicinity of the end of the wedge-shaped device 41 it becomes a plane surface. The space between the end of the wedge-shaped device and the sealing jaw 21 is covered by the matlike element 38, whose lower surface is at substantially the same distance from the material web 5 as the underside of the end of the wedge-shaped device 41.

During operation the mould track and the material webs 5, 6 move at constant speed in the direction of the arrow 39. After formation of the cavity, the filling material is filled in by means of the filler tube 15. Subsequently the material webs 5, 6 and the mould track pass the element 34, the concave underside of the wedge-shaped device 41 successively imparting a plane shape to the central area of the packing material web 5 at the same time as the central area, in preparation for the final sealing, is brought into contact with the parts of the first material web 6, which are situated on the tops of the partitions of the moulds 12. During the re-shaping of the central area of the second material web the excess filling material is displaced to the subsequent packing cavity. When the plane packing material web 5 has passed the wedge-shaped device 41 it remains pressed against the material web 6, thanks to the matlike element 38, so that no filling material can flow between the different packing cavities after the passing of the wedge-shaped device 41. Since the matlike element 38 at its rear end is joined to the sealing jaw 21, its reciprocating movement will be determined by the movement of the sealing jaw 21. The return movement of the element 38 (movement in opposite direction to the arrow 39) is thus very rapid, whilst the speed of the element 38 during the working stroke (in the direction of the arrow 39) corresponds to the speed of the mould chain. Independently of the position the element 38 is in, it will always completely cover the space between the wedge-shaped device 41 and the sealing jaw 21, and thus ensure that the central area of the material web 5 has plane shape and that the filling material cannot flow into the sealing area.

The recess situated in the underside of the wedge-shaped device 41 may in order to facilitate the re-shaping of the material web to plane shape have a surface provided with ridges or grooves. The grooves will run substantially longitudinally in the direction of movement of the material and contribute to the distribution of the excess filling material uniformly over the accessible width, so that the excess material is not collected in a longitudinal fold of the material web.

The matlike element 38 may be made of plastic material and has transverse grooves so as to facilitate bending during the movement past the curved part of the groove 37. The element may also be manufactured of a number of parallel bars of e.g. stainless steel which are joined together via hinges.

We claim:

1. In a machine for forming, filling and sealing packages including movable mould means for forming a series of interconnected U-shaped sections transversely in a first longitudinal web of flexible packaging material, means for forming spaced cuts along the side edges of a second longitudinal web of packaging material to form successive edge flaps along the edges of the second web, means for successively sealing transverse pairs of said edge flaps to the side edges of each U-shaped section to form a series of interconnected cavities, a filling tube extending parallel to the tops of the U-shaped sections and beneath the center longitudinal section of the second web for filling said cavities with a filling material, said center longitudinal section of the second web being outwardly bulged to accommodate said filling tube, reciprocating means for sealing the second web transversely to the transverse outer edges of the filled U-shaped sections of the first web to form sealed packages and means for separating each of the interconnected packages, the improvement comprising pressing means disposed substantially between the end of of the tube and the second mentioned reciprocating sealing means and including a reciprocatable mat-like element movable in the direction of the moving webs, means for guiding said mat-like element angularly toward the upper outer surface of the second web and then parallel to the tops of the U-shaped sections to press the second web against the outer transverse edges of the successive U-shaped sections to flatten the bulging center longitudinal section of the second web and to displace the filling material from between the webs in the areas to be sealed and thus maintain said mat-like element against the second web until the areas are sealed by said second mentioned reciprocating sealing means.

2. In a machine as claimed in claim 1 the improvement further comprising a wedge-shaped element disposed in the angle formed between the leading end of said mat-like element when being moved angularly toward the upper outer surface of the second web and the second web, the lower surface of the wedge-shaped element facing the second web having a leading convex shape to substantially conform to the bulged surface of the second web and progressively changing to a plane surface at the trailing edge of said wedge-shaped element in the direction of movement of the web, to bear against said web to flatten same, prior to contact with said mat-like element.

3. A machine as claimed in claim 1 the improvement further comprising means for reciprocatingly moving said mat-like element at the same speed as the movable mould means and for returning said mat-like element to its original position rapidly.

4. A machine as claimed in claim 1 the improvement wherein said mat-like element is composed of a flexible plastic sheet.

5. A machine as claimed in claim 1 the improvement wherein said mat-like element is composed of a plurality of parallel bar-like elements hinged along transverse axes.

6. A machine as claimed in claim 2 the improvement wherein said wedge-shaped element is provided with longitudinally extending ridges along the lower surface thereof.

* * * * *